US005762525A

United States Patent [19]

Candeloro

[11] Patent Number: 5,762,525

[45] Date of Patent: Jun. 9, 1998

[54] ELECTRICAL WIRING SYSTEM

[76] Inventor: Salvatore Candeloro, 1896 Jackson Rd., Penfield, N.Y. 14526

[21] Appl. No.: 692,764

[22] Filed: Aug. 6, 1996

[51] Int. Cl.[6] ..... H01R 17/00

[52] U.S. Cl. ..... 439/660; 439/208; 439/211; 439/284

[58] Field of Search ..... 439/660, 110, 439/115, 117, 207, 208, 211, 284, 295, 732, 105, 652, 607, 209, 928

[56] References Cited

U.S. PATENT DOCUMENTS

| | | | |
|---|---|---|---|
| 3,253,085 | 5/1966 | Stern . | |
| 3,715,627 | 2/1973 | D'Ausilio . | |
| 3,997,225 | 12/1976 | Horwinski | 439/105 |
| 4,083,617 | 4/1978 | Wyatt | 439/295 |
| 4,173,382 | 11/1979 | Booty . | |
| 4,231,630 | 11/1980 | Propst et al. . | |
| 4,239,932 | 12/1980 | Textoris et al. . | |
| 4,270,020 | 5/1981 | Kenworthy et al. . | |
| 4,631,648 | 12/1986 | Nilssen . | |
| 4,990,098 | 2/1991 | Neidecker et al. | 439/207 |
| 5,162,614 | 11/1992 | Bogiel et al. . | |
| 5,380,225 | 1/1995 | Inaoka | 439/660 |
| 5,433,633 | 7/1995 | Matsumoto et al. | 439/607 |
| 5,572,779 | 11/1996 | Adelman et al. | 29/874 |
| 5,593,311 | 1/1997 | Lybrand | 439/295 |

FOREIGN PATENT DOCUMENTS

| | | | |
|---|---|---|---|
| 002039421A | 8/1980 | United Kingdom | 439/284 |

*Primary Examiner*—P. Austin Bradley
*Assistant Examiner*—Tho D. Ta
*Attorney, Agent, or Firm*—Cumpston & Shaw

[57] ABSTRACT

An electrical wiring system for conducting electricity through an insulated casing is described. The electrical wiring system includes a substantially rigid conducting line having an insulating casing and a plurality of electrical conducting cells embedded in the insulating casing, each conducting cell comprising a metal conductor, and a substantially rigid connector for connecting to the conducting line, the connector comprising an insulating sheath and a plurality of insulated electrical conducting metal through-prongs recessed within the insulating sheath. The insulating casing and the connector plug-in to each other without hard-wiring. The electrical wiring system includes additional plug-in components such as electrical receptacle boxes and switches, corner adapters and power adapters which extend the system without hardwiring.

18 Claims, 10 Drawing Sheets

FIG. 6
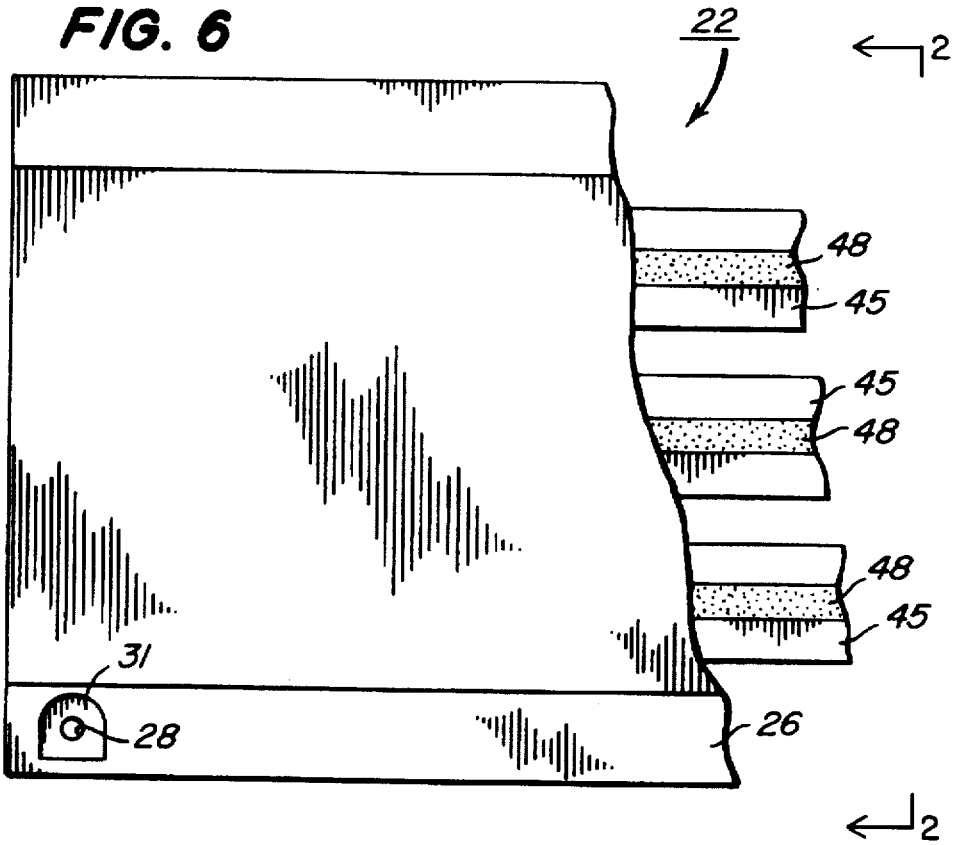
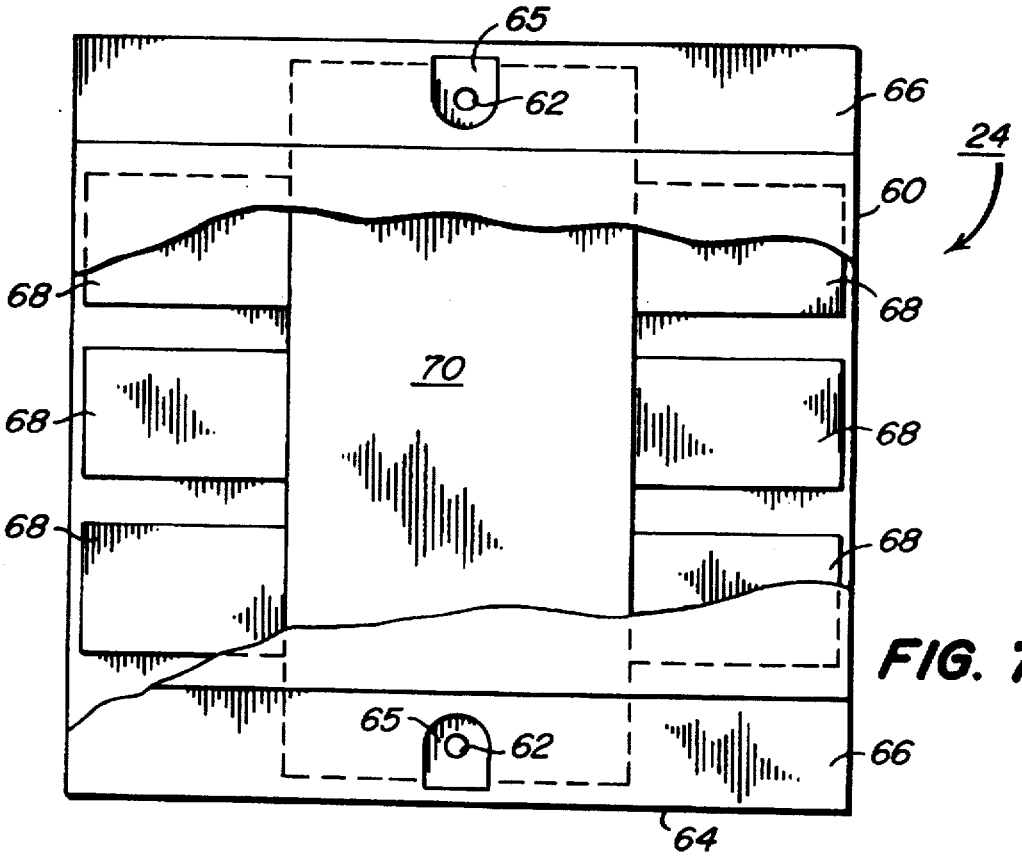
FIG. 7

FIG. 14
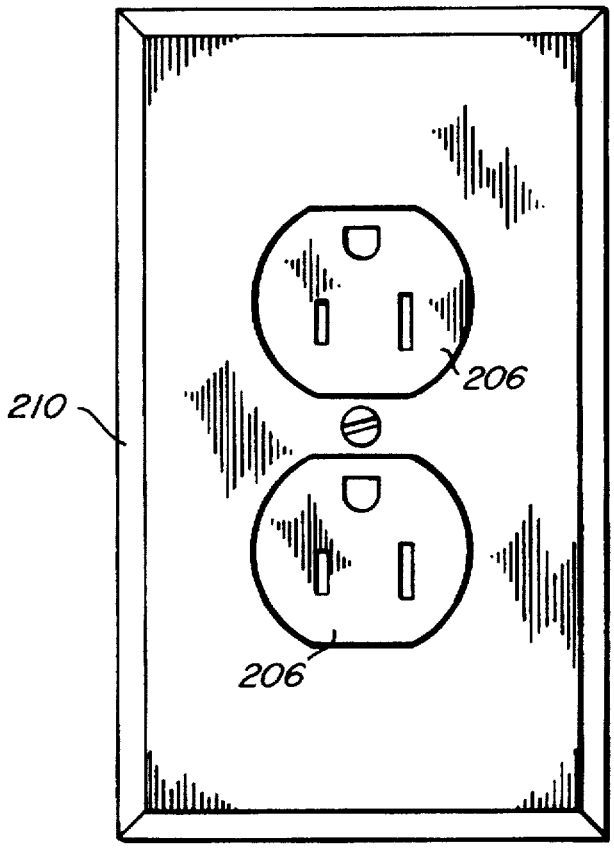
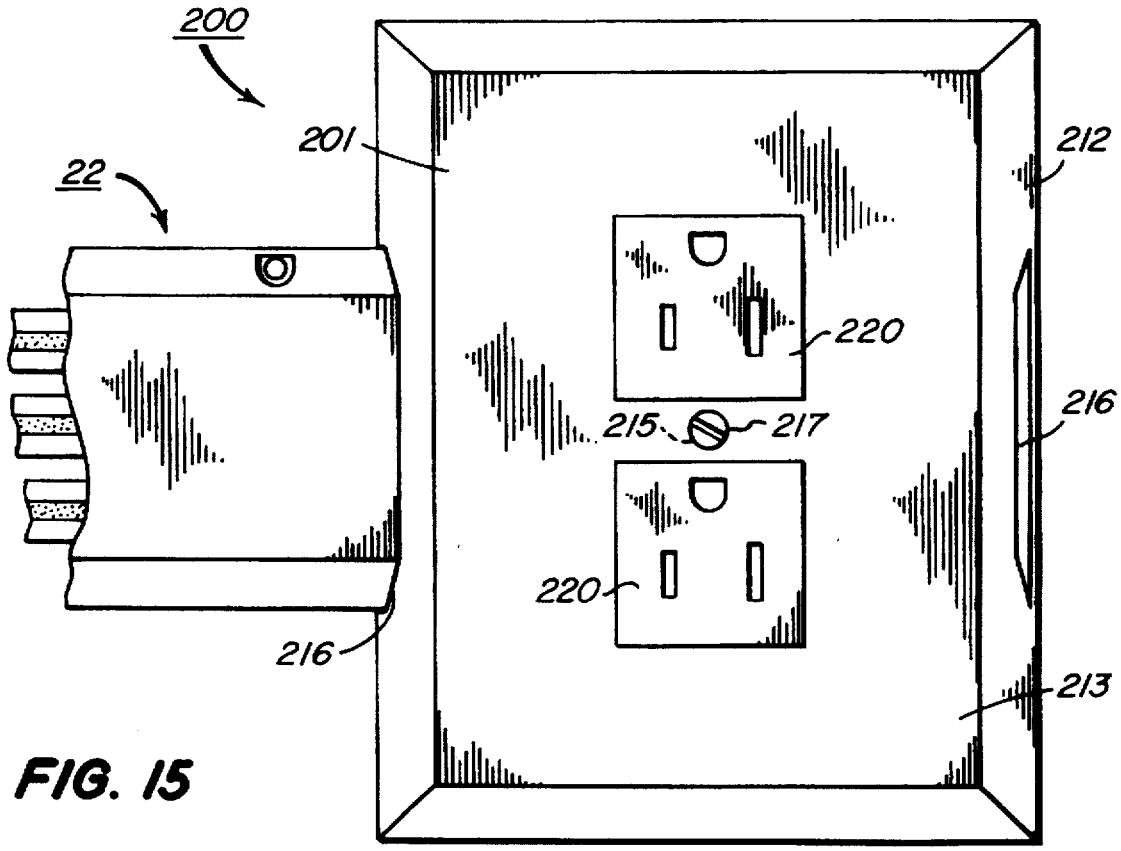
FIG. 15

FIG. 16
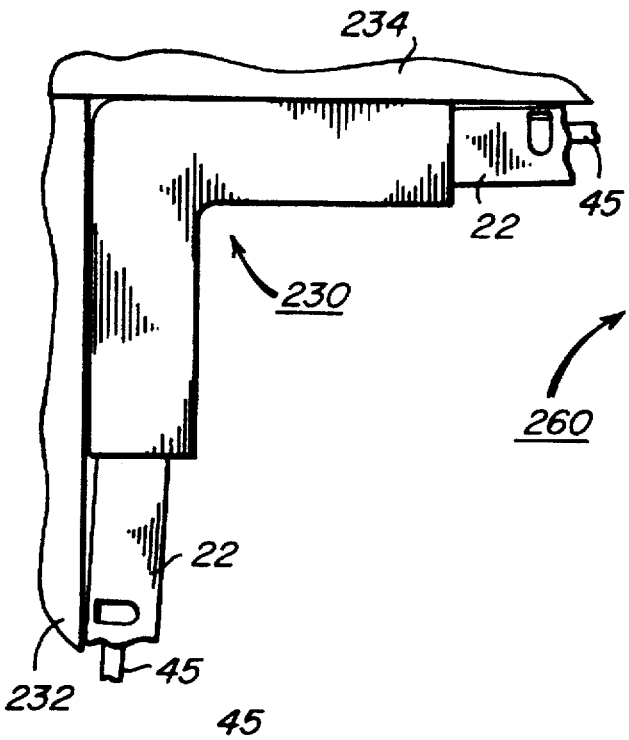
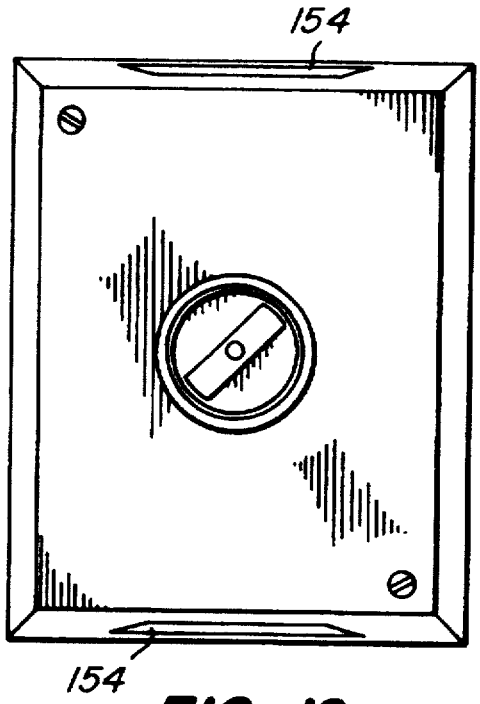
FIG. 18
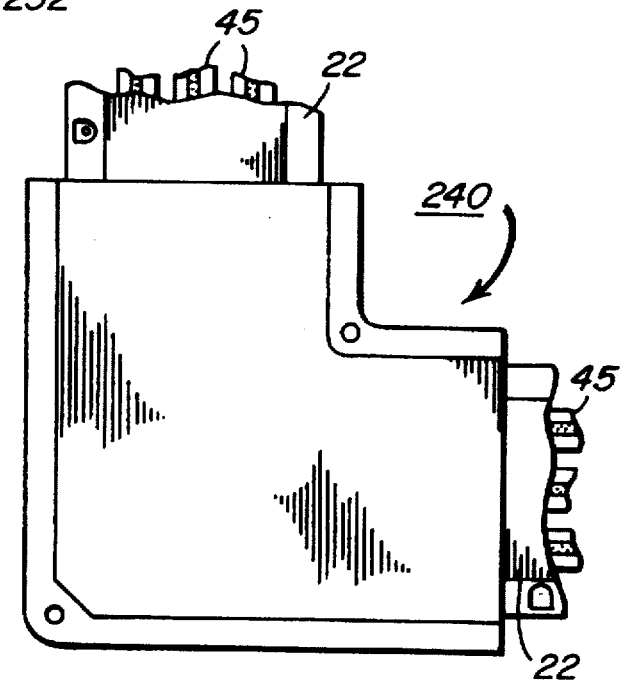
FIG. 17
FIG. 19
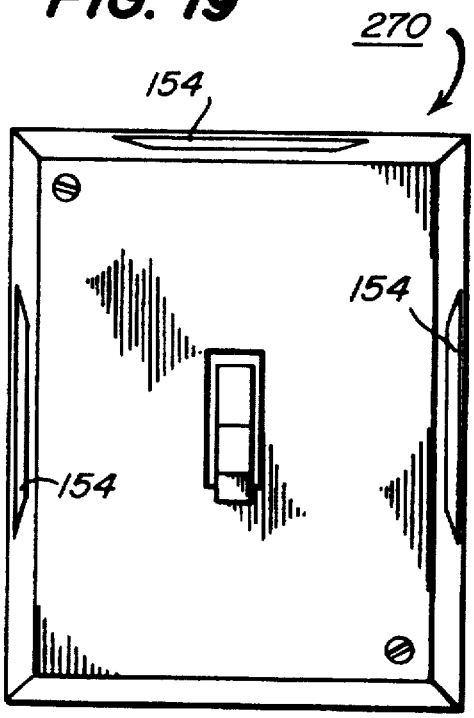

ELECTRICAL WIRING SYSTEM

FIELD OF THE INVENTION

This invention relates generally to an electrical wiring system and in particular to a pre-formed system of electrical components containing conducting metal strips which snap together without hardwiring.

BACKGROUND OF THE INVENTION

Hollow conduit has been used to enclose insulated electrical wires in installations where the wire has to be protected from the environment. Typically such conduit is used on exterior surfaces or underground. Bundles of wires are fed through a hollow casing and each wire is hardwired to outlets and switches fastened to the exterior surface of the casing in special boxes. Complete insulation and protection of hardwired systems is hard to achieve. Hard wiring is labor intensive and time consuming and, therefore, expensive.

U.S. Pat. No. 3,715,627 describes a pre-formed electrical wiring system with plug-in electrical components and lines which utilize conductive wires embedded within a flexible insulating material. Each line comprises a plurality of conductive wires and at least one soft metal wire to provide a means for forming a line to any required shape. The bare conducting wires extend from the insulation and connections between components are made with male-to-female plug-in connections. The wiring system is adapted for interior use and is embedded within a molded structure. There is no disclosure of any rigid, weatherproof structure for exterior use of the lines.

It is an objective of this invention to provide a pre-formed electrical wiring system, suitable for exterior use, which eliminates loose wires and hardwiring, is easy to install and is completely insulated from the environment.

SUMMARY OF THE INVENTION

Briefly stated the invention is for an electrical wiring system comprising; a substantially rigid insulating casing; a plurality of insulating carriers in the insulating casing and a space formed adjacent to each insulating carrier; a first metal strip carried by the insulating carrier and at least partially filling a width of the insulating carrier so that the first metal strip and the space form a female connector; a substantially rigid connector comprising an insulating sheath; a plurality of electrical conducting first through-prongs recessed within the insulating sheath; an insulator surrounding a mid-portion of each one of the plurality of first through-prongs so that each first through-prong is isolated from each other first through-prong; and a plurality of second conductive metal strips, one second metal strip extending along an entire length of each first through-prong and at least partially filling a width of each first through-prong so that the first through-prong forms a first male connector; in which the insulating casing and the connector plug in to each other so that one first metal strip electrically contacts one second metal strip.

In another aspect of the invention there is provided an electrical wiring system comprising: a substantially rigid insulating casing; a plurality metal bars in the insulating casing and a space formed adjacent to each metal bar so that the metal bar and the space form a female connector; a substantially rigid connector comprising an insulating sheath; a plurality of electrical conducting metal through-prongs recessed within the insulating sheath so that each metal through-prong forms a male connector; and an insulator surrounding a midportion of each one of the plurality of metal through-prongs so that each metal through-prong is isolated from each other metal through-prong; in which the insulating casing and the connector plug into each other and one metal through-prong electrically contacts one metal bar.

In another aspect of the invention the electrical wiring system includes additional plug-in components such as electrical box outlets and switches, corner adapters and power adapters fitted with male connectors which extend the system without hardwiring.

BRIEF DESCRIPTION OF THE DRAWINGS

FIG. 6 is a top plan view of the conducting line of FIG. 2, partially cut away.

FIG. 7 is a top isometric view of the connector of FIG. 1, partially cut away.

FIG. 14 illustrates a conventional duplex wall switch.

FIG. 15 illustrates a top view of a power adapter.

FIG. 16 illustrates a ceiling comer adapter.

FIG. 17 illustrates a wall comer adapter.

FIG. 18 illustrates a light socket.

FIG. 19 illustrates a wall switch.

DETAILED DESCRIPTION OF THE INVENTION

The pre-formed electrical wiring system of the invention provides a method for conducting electricity through an insulated casing. The electrical wiring system includes a conducting line which is connected to an existing power source and is designed to be continued and assembled with other electrical components of the system such as connectors, adapters, electrical receptacle boxes and switches, without hardwiring.

In one embodiment for light industrial or domestic use the electrical wiring system includes a conducting line, made of a substantially rigid insulating plastic, in which individual conducting cells are encased and insulated from each other by the plastic. A conducting cell carries a single metal conductor, with or without an insulating carrier for holding the metal conductor, and has a space adjacent to the metal conductor or the insulating conductor so that a female connector is formed. In an industrial version of this embodiment the plastic casing around the cells is encased in a metal sheath. In another embodiment for heavy industrial use the conducting line has individual conducting cells which are insulated and encased in metal tubes, and the tubes are themselves encased in an insulating plastic. Each version of the conducting line is assembled with other modular components of equivalent structure and materials. In all versions of the electrical wiring system modular components are designed to sealingly plug into each other and are thus assembled without hardwiring.

The electrical wiring system can be adapted to carry two or more conducting cells according to the electrical requirements for the job at hand. The conventional 2-wire, 2-wire with ground, or 3-wire with ground can be replaced with 2-cell, 3-cell or 4- cell systems respectively. The electrical wiring system of the invention is illustrated for use with a conventional alternating current 3-cell system having a positive, neutral and ground arrangement. The polarized arrangement of the conducting cells separates the positive (hot) cell and the neutral cell with the ground cell in the center of the arrangement. For ground fault interrupter (GFI) circuits this arrangement would favor a GFI trip should a fault situation occur. The modular design of the conduit is uniform through-out the system and polarization is maintained.

FIGS. 1–7 illustrate an embodiment of the invention which can be used in the home and for light industrial applications.

Figure 1:
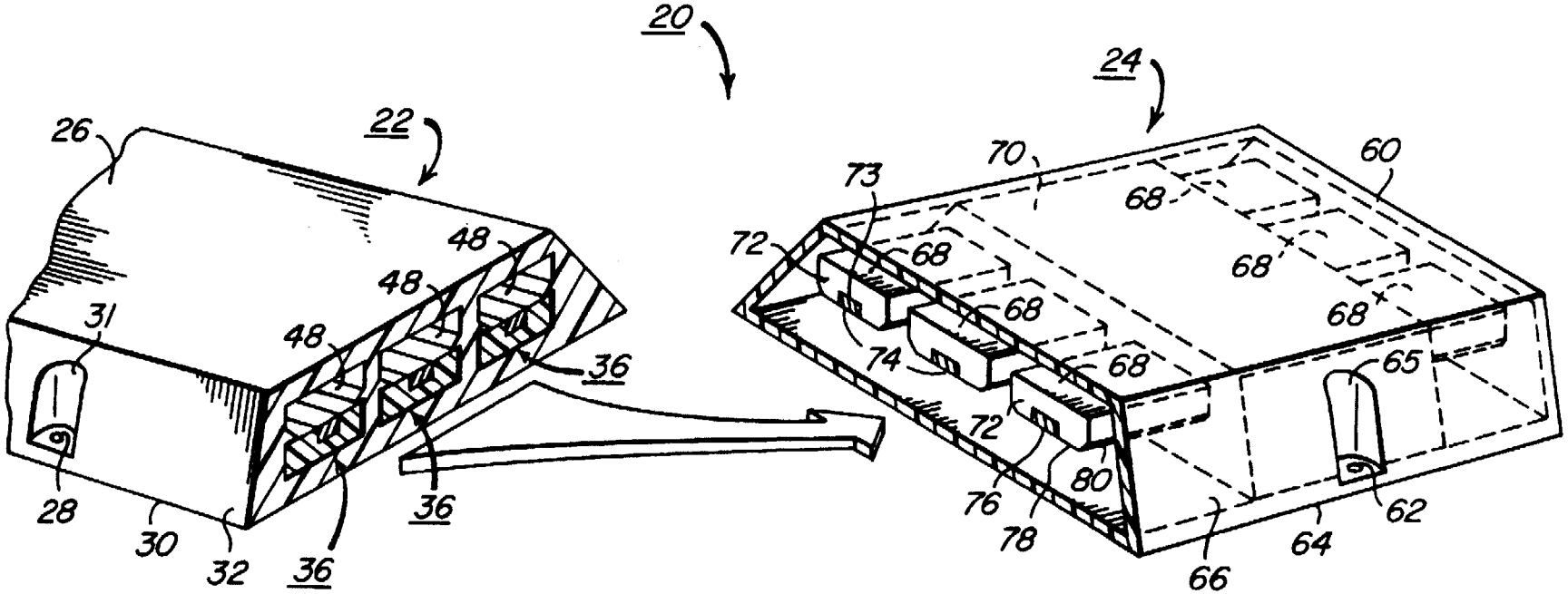
FIG. 1 is an isometric view of an electrical wiring system showing a conducting line and a connector.
Figure 2:
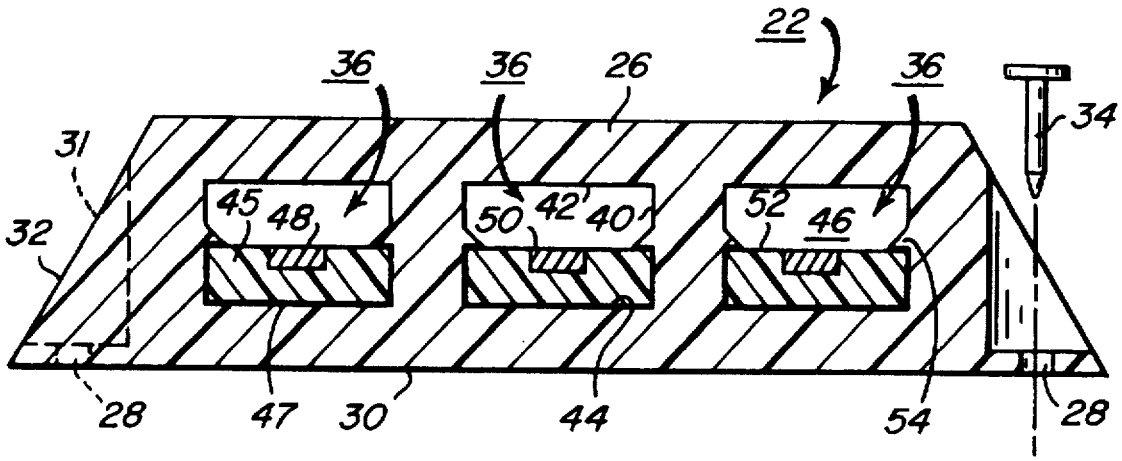
FIG. 2 is an end section view of a conducting line.

Referring to FIGS. 1 and 2 there is illustrated an electrical wiring system 20 which includes a conducting line 22 and a connector 24 designed to connect individual conducting line sections together by male-to-female connections. The conducting line 22 and the connector 24 are substantially rigid structures and cannot be bent over a small radius. Separate components with pre-formed shapes are used at bends and corners to re-route the conducting line as necessary and are described in FIGS. 16-20 below.

The conducting line 22 includes an insulating casing 26 of a plastic material. The casing 26 has a generally trapezoid shape with mounting holes 28 penetrating the flat base 30 and the angled side 32. The angled side 32 has a notch 31 for receiving a fastener 34. The fastener 34 is used to attach the conducting line 22 to a flat structure such as a wall. The casing 26 encloses three conducting cells 36. Referring to FIG. 2, each conducting cell 36 leads a conductor through the conducting line 22, the cell 36 having walls 40, a top 42 and a bottom 44. The walls of the cell 36 encompass an insulating carrier 45 and a space 46 formed by the carrier 45, the walls 40 and the top 42. Each carrier 45 includes a channel 47 and a conducting metal strip 48 embedded in the channel 47 so that the surface 50 of the metal strip 48 is level with the surface 52 of the carrier 45. The channel 47 and the embedded metal strip 48 extend the length of the carrier 45. The metal strip 48 and the space 46 thus form a female connector. The size of the metal strip 48 can be changed to provide desired current carrying capacity.

The cell 36 is preferably rectangular-shaped although other shapes can be used. In one embodiment of the conducting line 22 the walls 40 of each cell 36 are provided with recesses 54 at the junction of the carrier 45 and the space 46 to capture and align a corresponding male prong and prevent its displacement.

Referring to FIGS. 1 and 7 there is illustrated an embodiment of a male connector 24 for connecting together lengths of the conducting line 22. The connector 24 includes an insulating sheath 60 in the shape of a trapezoid with holes 62 through the base 64 and the angled sides 66. The angled side 66 has a notch 65 for receiving a fastener. The sheath 60 encloses three conducting through-prongs 68. A mid-portion of each through-prong 68 is surrounded by an insulator 70 so that each through-prong is isolated from each other through-prong. The through-prongs 68 are recessed within the sheath 60 and the sheath 60 is dimensioned to receive the conducting line 22 therein in a sealing relationship. Each through-prong 68 is formed of a rigid, insulating holder 72 and includes a channel 73 and a conductive metal strip 74 embedded in the channel 73 of the through-prong 68 so that the surface 76 of the strip 74 is level with the surface 78 of the through-prong 68. The channel 73 and the metal strip 74 extend the length of the through-prong 68. The through-prong 68, together with the strip 74, thus forms a male connector. The sheath 60 provides a weather tight seal with the conducting line 22. The seal can be enhanced by coating one or both of the contacting surfaces of the sheath and the conducting line with an adhesive.

The through-prongs 68 are preferably rectangular shaped although other shapes can be used. In one embodiment of the connector 24 the through-prongs 68 are shaped with angled shoulders 80 for inserting the through-prongs 68 into the recesses 54 of the cell 36 (FIG. 2).

Figure 5:
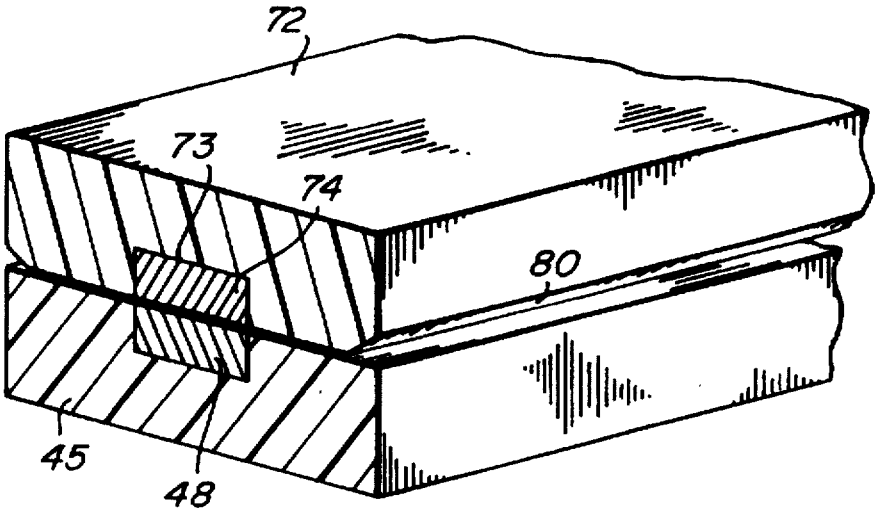
FIG. 5 is a partial view of an end section of conductors in contact.

Referring to FIG. 5, there is illustrated the manner in which conducting strips 48 in the carrier 45 of the female connector and the conducting strip 74 in the channel 73 of the male conductor make contact when the conducting line and the connector are connected.

Referring to FIG. 6, there is shown a top cut-away view of the conducting line 22 of FIGS. 1 and 2 with the insulating casing 26. The conductive metal strips 48 are embedded along the length of each carrier 45.

Figure 3:
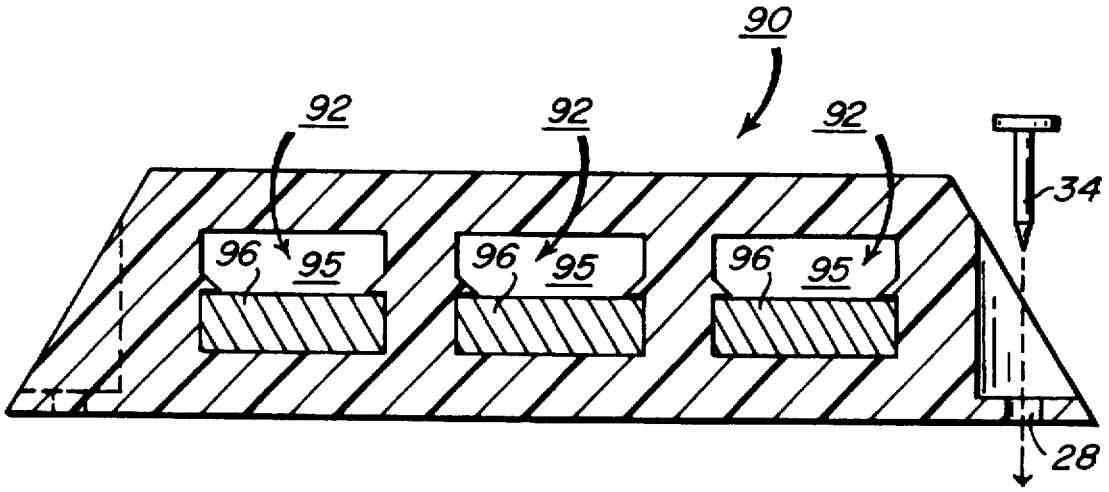
FIG. 3 is an end section view of a conducting line.

Referring to FIG. 3, there is shown another embodiment of a conducting line 90 having three conducting cells 92. Each conducting cell 92 includes a space 95 and a conducting bar 96 in which the bar 96 is made entirely of a metal conductor. Matching components, such as connectors corresponding to connector 24, for use with the conducting line 90 would be provided with all metal through-prongs.

Figure 4:
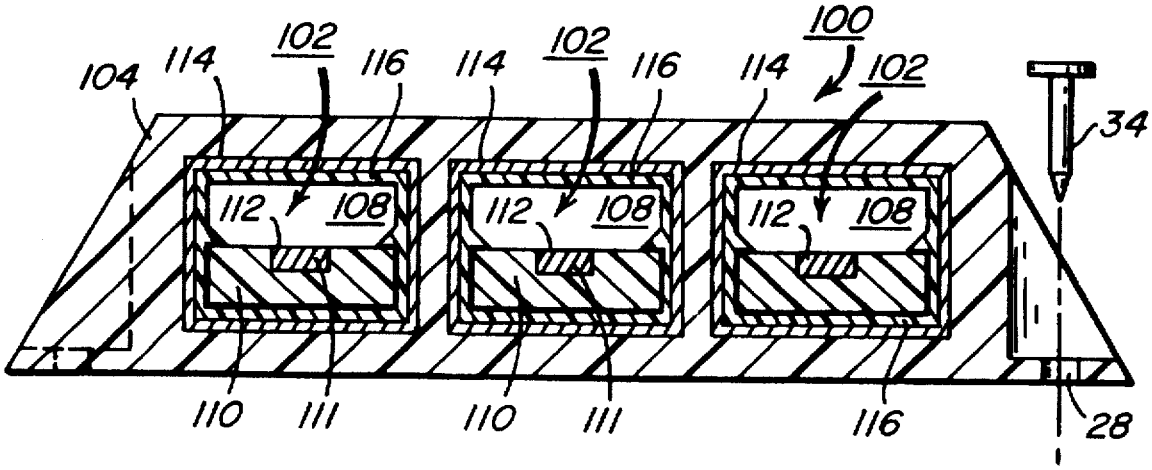
FIG. 4 is an end section view of a conducting line.

Referring to FIG. 4, there is illustrated another embodiment of a conducting line 100 with conducting cells 102 embedded in an insulating casing 104. Each conducting cell 102 has a space 108 and an insulating carrier 110. The carrier 110 includes a channel 111 and a conductive metal strip 112 embedded in the channel 111. To provide additional support and protection a metal tube 114 surrounds the cell 102 and an insulating layer 116 lines the metal tube 114.

Figure 8:
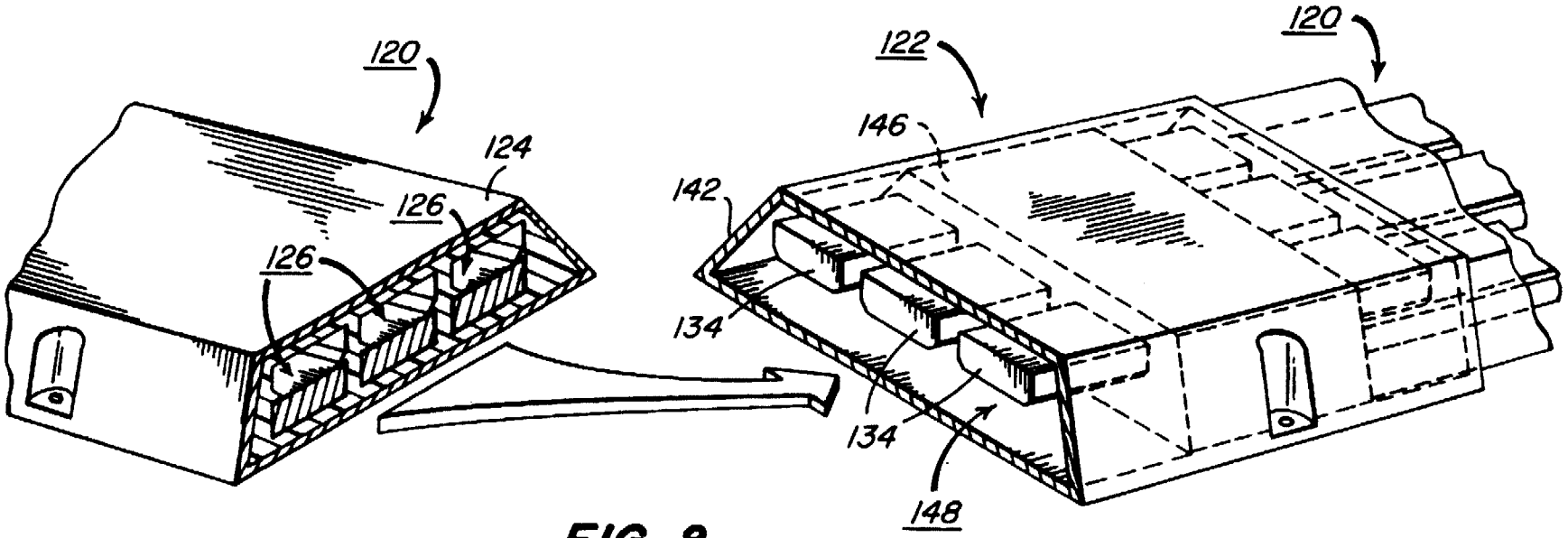
FIG. 8 is plan view of an electrical wiring system showing a conducting line and a connector.
Figure 9:
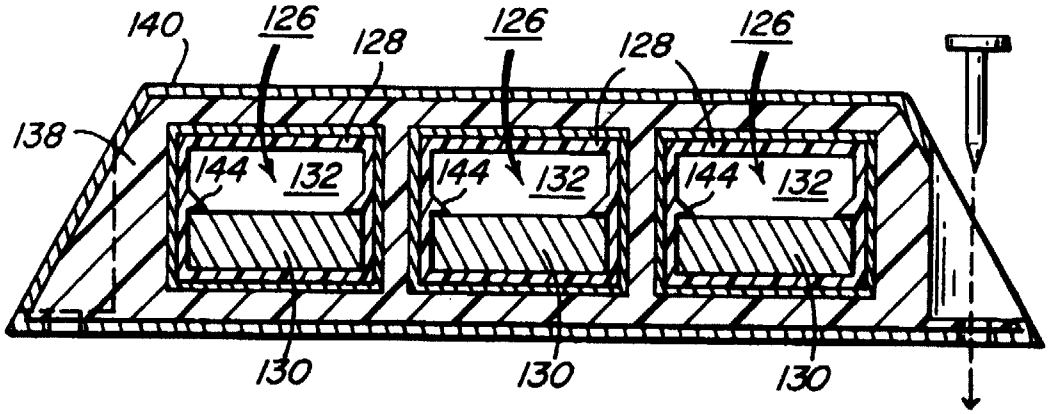
FIG. 9 is an end section view of a conducting line.

FIGS. 8 and 9 illustrate an embodiment of the electrical wiring system of the invention for heavy industrial use. Rectangular shaped conducting lines and adapters are illustrated which can be mounted on walls with clamps and straps. Other shapes with provisions for mounting holes are also contemplated.

Referring to FIG. 8 there are shown two conducting line sections 120 and a male connector 122 designed to connect the two conducting line sections 120 together. The conducting line 120 is of a substantially rigid construction and cannot be bent over a small radius. Separate elements with pre-formed shapes can be used at bends or corners as required. The conducting line 120 includes a metal cover 124 which encloses three insulated conducting cells 126.

Referring to FIG. 9, each of the cells 126 is constructed with a metal tube 128. The metal tube 128 is partially filled with an electrical conductor 130. In this embodiment the conductor 130 fills approximately half of the tube volume and is an all metal bar. The space 132 is sized to receive the conducting through-prongs 134 of the connector 122. The metal tube 128 and conductor 130 are preferably rectangular shaped although other shapes can be used. In a preferred embodiment the cover 124 is further strengthened with an insulating filler 138 between the cells 126 and the cover walls 140. An insulating layer 144 lines the inside of the metal tube 128.

Referring again to FIG. 8, there is illustrated an embodiment of an industrial male connector 122. This embodiment has three all metal conducting through-prongs 134 enclosed within a metal sheath 142. An insulator 146 surrounds each of the through-prongs 134 to isolate the through-prongs from each other and from the metal sheath 142. The connector 122 is constructed so that the through-prongs 134 are recessed in the sheath 142. The sheath 142 is sized so that it can receive the cover 124 of the conducting line 122 when the through-prongs 134 are inserted into the space 132 of the conducting line 120 and the through-prongs 134 contact the conductors 130. The recess portion 148 of the connector can have any desired length as required. The metal sheath 142 provides a weather tight seal with the conducting line 120.

The connectors of FIGS. 1 and 8 have through-prongs sized and shaped to fit in the spaces defined within the conductor cells of the conducting line.

It will be apparent that the all metal conductors of the industrial-type cells and through-prongs can be replaced by insulating carriers partially filled with metal conducting strips as described above.

In all the embodiments of the electrical wiring system of the invention the metal conductors used to form the conductor strips and the all metal conductors can be any suitable conducting metal or metal alloy, such as copper, aluminum, copper clad aluminum and copper alloy.

The insulating compositions used throughout the system, for example to form the substantially rigid conducting line, the conductor cell carrier and the conductor through-prongs can be the same or different. The compositions should be resistant to cracking due to extremes of heat and cold. Suitable insulating compositions with the desired insulating properties, strength and rigidity over the required temperature ranges include plastics, such as thermoplastic and thermosetting resins. Suitable resins include polycarbonates (PC), acrylonitrile-butadiene-styrene resins (ABS) and poly (phenylene oxide) resins (PPO). The heavy duty versions of the conducting line in which the conductor cell is housed within a metal tube have, in addition, an insulating material between the metal tube and the cell. This insulating material may be selected from the insulating materials described above and from more flexible materials, such as a rubber, for example a silicone rubber.

The metal cover 124 and the metal sheath 142 in the industrial version are preferably formed from a semi-rigid metal, for example aluminum, which is resistant to weather and corrosion since many of the applications for conducting line are on outside surfaces or underground. Similarly, the metal tube surrounding the channel portion in some embodiments is made of a semirigid metal, such as aluminum.

The conducting lines and connectors are formed by conventional extrusion or molding techniques which are well known to those with ordinary skill in the art to which it pertains. For example, the plastic insulating compositions can be co-extruded or molded with the conductors. Alternatively the plastic compositions are extruded or molded separately to pre-form the conducting cells. The conductors are then inserted into the conducting cells. The conductors may, in addition, be adhesively attached to the cell. The conducting lines and connectors are designed to be integrated into other electrical components of the electrical wiring system. The structure and materials of the other electrical components are selected to match the type of conducting line being used.

Figure 10:
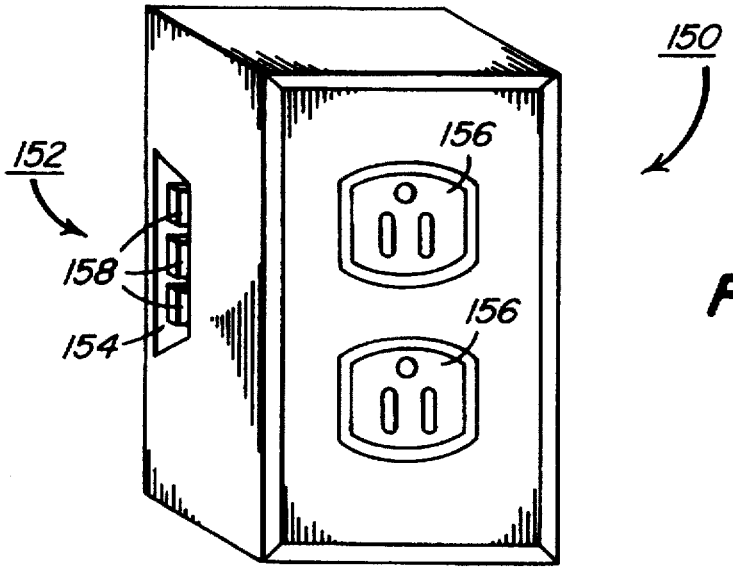
FIG. 10 illustrates an angled view of an outlet box.

Referring to FIG. 10 there is shown a receptacle box 150 which has an opening 152 containing a male connector 154 integrated electrically with the sockets 156 and adapted to receive the end of the female conducting line, for example conducting line 22. The male connector 154 includes connector prongs 158 which have the same construction as the male through-prongs, for example through-prongs 68 described for the connector 24. The opening 152 is sized to receive the casing 26 of the conducting line 22 when the conducting line 22 is plugged into the receptacle box 150. The receptacle box 150 can be provided with two male connectors 154, one connector 154 on each side, to allow the conducting line to be led through the box 150. Each connector 154 being electrically connected with the other, for example by bus-bars. The construction and materials of the male connector 154 are the same as for the connectors described above.

Figure 11:
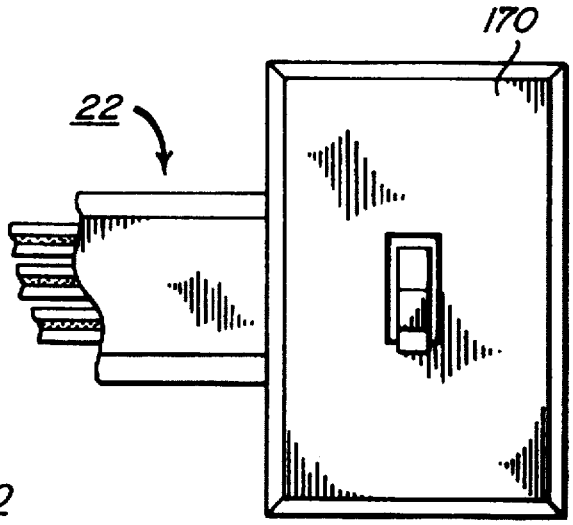
FIG. 11 illustrates a switch box.

Referring to FIG. 11, there is shown a front view of a wall switch 170 which can be adapted in the same manner as the above described receptacle box to receive the conducting line 22 directly.

Figure 12:
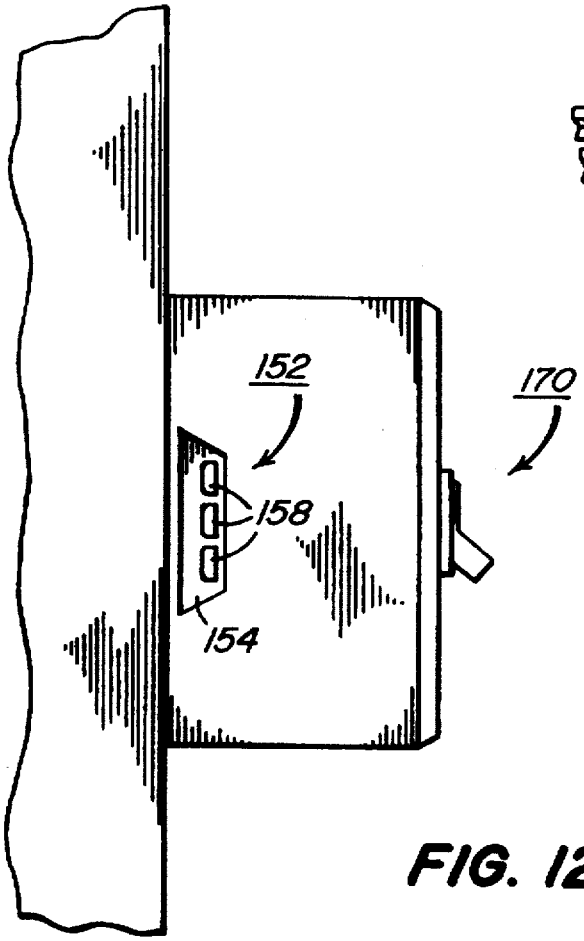
FIG. 12 illustrates a side view of a switch box.

Referring to FIG. 12, there is shown a side view of the wall switch 170 with an opening 152 containing a male connector 154 on one side. The male connector 154 has connector prongs 158. The prongs 158 have the same construction as the male connector prongs 68 described above.

Installation of the electrical wiring system requires a connection to an existing power source. This connection can be achieved in a number of ways, for example, by plugging a power adapter into an existing conventional wall socket and then plugging a conducting line into male connectors of the power adapter.

Figure 13:
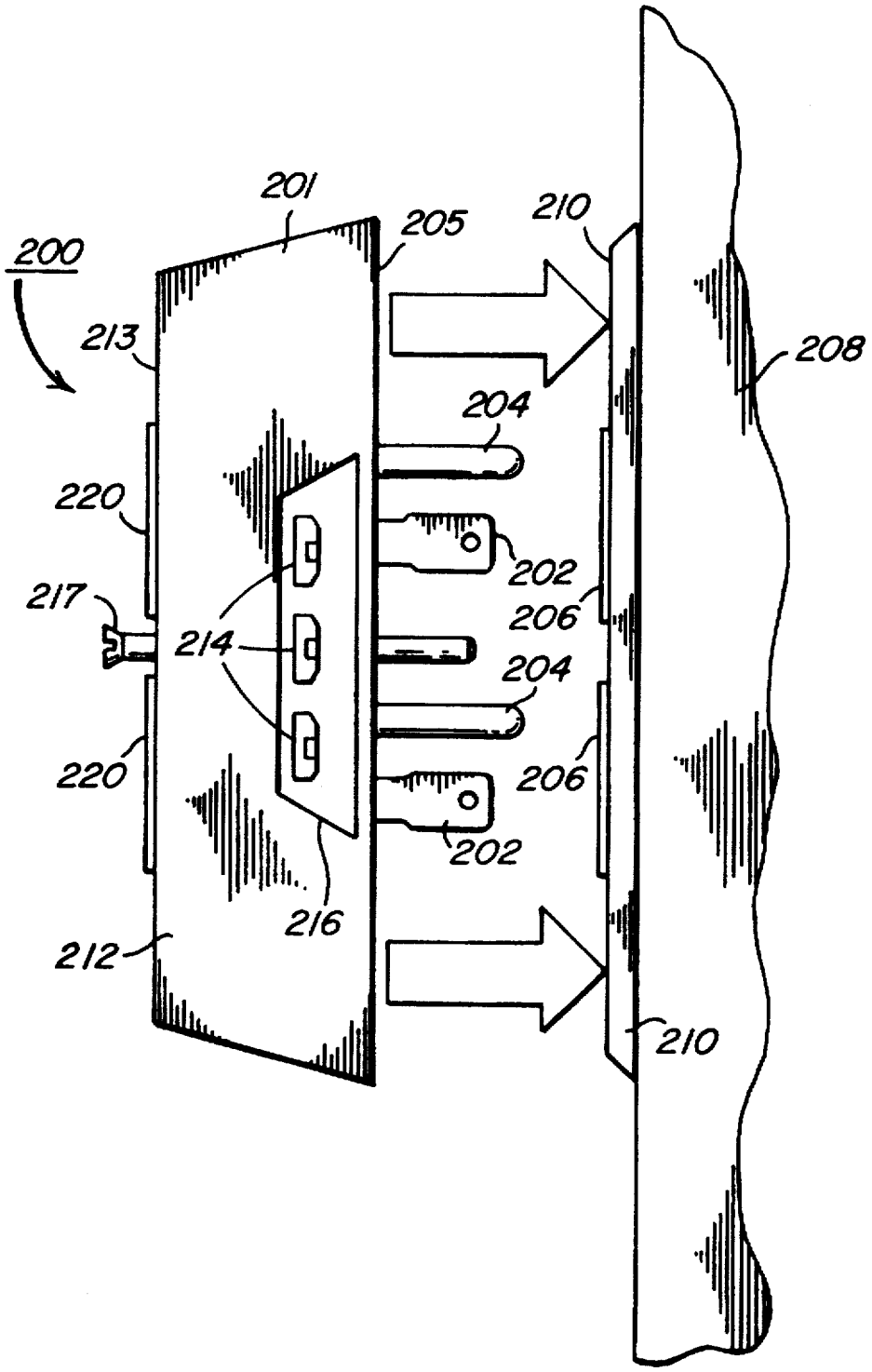
FIG. 13 is a side view of a power adapter.

FIGS. 13 and 15 illustrate a duplex-type power adapter 200. The adapter includes a housing 201 which is fitted with conventional conductive pins, for example hot pins 202 and ground posts 204 for plugging into an existing conventional 3-prong duplex wall receptacle 206 (FIGS. 13 and 14) The conductive pins 202, 204 protrude from the back 205 of the housing 201. The duplex wall receptacle 206 is normally mounted in a receptacle box which is recessed in a wall 208 and is conventionally wired to a power source. A wall plate 210 of the receptacle box is mounted flush with the wall 208. The side walls 212 of the power adapter 200 extend beyond the back 205 so that the housing 201 mounts over the wall plate 210 and forms a weather tight seal with the wall 208. The wall plate 210 is usually removed before the power adapter is connected. The housing 201 is provided with a mounting hole 215 and fastener 217 for attaching the power adapter 200 to the duplex wall receptacle 206. The housing 201 is provided with the male connectors 214 mounted in openings 216 on one or more side walls 212 of the housing 201 to which a conducting line 22 can be connected (FIG. 15) and thus the circuit can be extended from the power adapter 200. In a preferred embodiment the adapter is also provided with duplex receptacles 220 mounted in the front 213 of the housing 201 for receiving conventional wired plugs. Internally the power adapter male connectors 214 and the conventional pins 202 and posts 204 are connected by conventional bus-bar connections which are well known to those with ordinary skill in the art to which it pertains.

The circuit can be extended in different directions and around inside and outside corners by means of appropriately shaped and angled double male connectors constructed in the same way as the connector 24 of FIG. 1.

FIGS. 16 and 17 illustrate two angled embodiments of such corner-connectors. FIG. 16 illustrates a ceiling-type connector 230 in which conducting line 22 is plugged into male connectors at each end, thus enabling the circuit to be extended from a wall 232 to a ceiling 234. FIG. 17 illustrates a wall-type connector 240 in which conducting line 22 is plugged into male connectors at each end, thus enabling the circuit to be extended from a horizontal direction to a vertical direction on a wall. In a preferred embodiment of the connectors 230, 240 the connectors are constructed with the same materials as the connector 24 (FIG. 1) and the male connectors are through-prongs adapted to the L-shape of the comer-connectors.

FIG. 18 illustrates a light socket 260 with male connectors 154 built into two sides for extending the circuit.

FIG. 19 illustrates a wall switch 270 with male connectors 154 built into three sides for extending the circuit.

Figure 20:
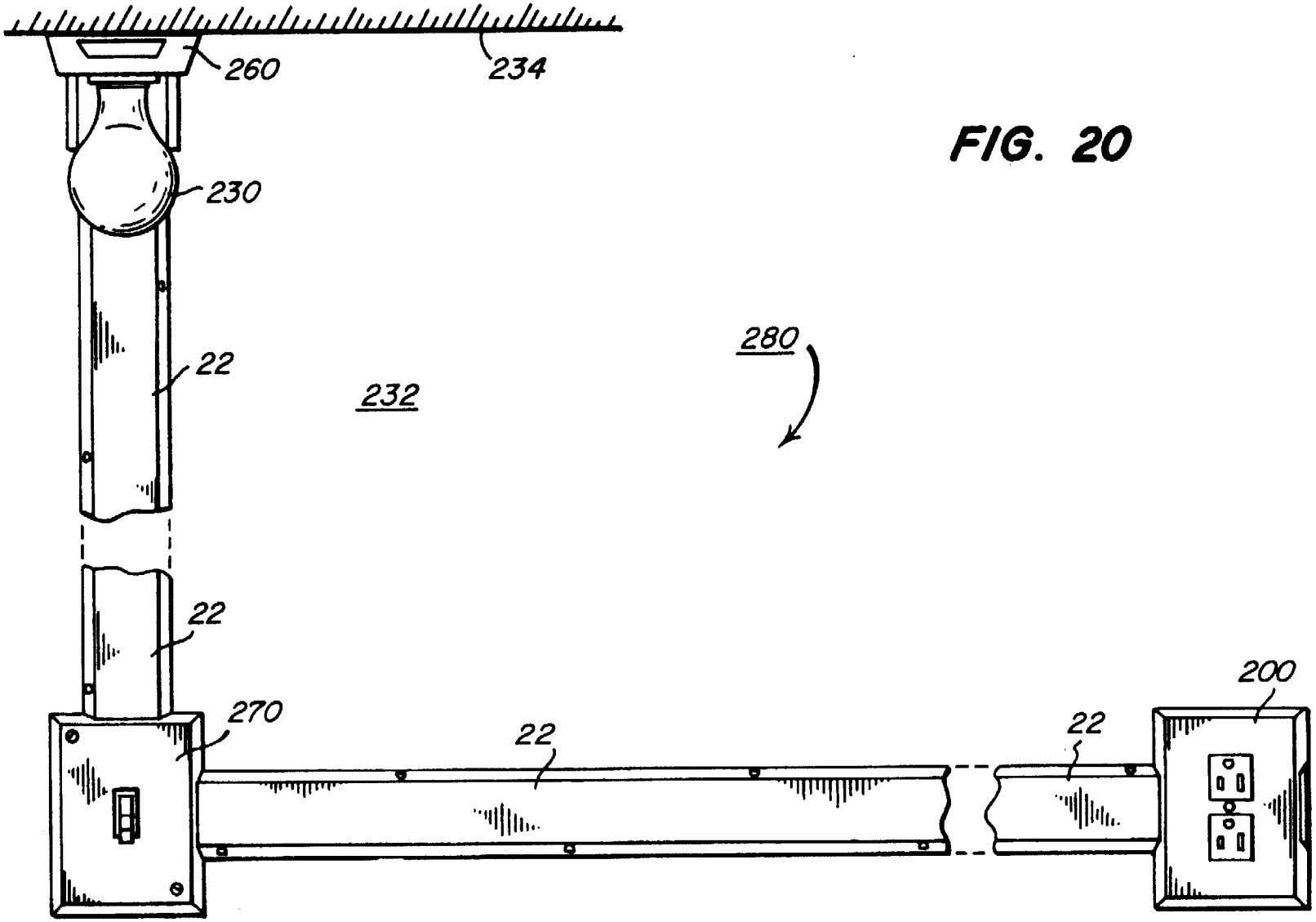
FIG. 20 illustrates an electrical circuit.

FIG. 20 illustrates a circuit 280 consisting of the power adapter 200, conducting line sections 22, a wall switch 270, the ceiling connector 230 and light socket 260.

The electrical wiring system is readily adapted to meet current recommendations and codes for electrical circuits. The insulators and conductors can be selected, sized and combined to match the temperature and overcurrent protection ratings of conventional wiring systems. The size of the metal conducting strip can be changed to provide desired current carrying capacity.

The current carrying capacity of standard sizes of Romex-type copper wire covered by different insulators and the corresponding temperature ratings are given in Table 1.

TABLE 1

| Current Carrying/Ampacity Values (amps) | | | | |
|---|---|---|---|---|
| Wire size | | Temperature Rating/Insulation Type | | |
| AWG | Area ($in^2$) | 60° C./TW | 75° C./THHN | 90° C./THHN |
| 14 | .003 | 20 | 20 | 25 |
| 12 | .005 | 25 | 25 | 30 |
| 10 | .008 | 30 | 35 | 40 |

The overcurrent protection for conductor types shown in Table 1 should not exceed 15 amps for size 14, 20 amps for size 12, and 30 amps for size 10 wires after any correction factors for ambient temperature and the number of conducting wires have been applied.

In the wiring system of the invention the current carrying capacity of different sizes of single insulated copper alloy conducting cells with different insulators and the corresponding temperature ratings are given in Table 2.

TABLE 2

| Current Carrying/Ampacity Values (amps) | | | |
|---|---|---|---|
| Wire Size | Temperature Rating/Insulating Type | | |
| Area ($in^2$) | 60° C./ABS | 113° C./PC + ABS | 116° C./PPO |
| .003 | 20 | 40 | 40 |
| .005 | 40 | 40 | 40 |
| .008 | 40 | 40 | 40 |

The overcurrent protection for conducting cells shown in Table 2 should not exceed 30 amps for all categories after any correction factors for ambient temperature and the number of conducting cells have been applied.

The electrical wiring system of the invention replaces the conventional method of installing hollow conduit to an exterior wall to assemble outlets and switches where wire bundles are then fed through the hollow casing and outlets and switches must be hardwired. The electrical wiring system of the invention is readily connected to an existing power source and the components are easy to snap together and assemble without hardwiring. Installation can be carried out quickly and safely with minimum exposure to sources of electrical voltage and current. The assembled circuit is weather resistant. Other electrical circuits also fall within the invention and other elements not specifically shown or described may take various forms known to persons of ordinary skill in the art.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. An electrical wiring strip comprising:

an elongated insulating body having a substantially uniform cross section throughout its length and first and second substantially planar end surfaces at opposite ends of the strip;

a plurality of generally flat, electrically conductive strips embedded in the body, extending through the body and terminating in the same planes of the first and second end surfaces; and a plurality of separate cavities formed in the body adjacent to the conductive strips, extending from each of the first and second end surfaces into the body, so that a surface portion of each conductive strip is exposed within the adjacent cavity for engaging an electrically conducting mating connector.

2. The wiring strip according to claim 1, in which each conductive strip fills the width of each cavity.

3. The wiring strip according to claim 1, having a metal cover surrounding the insulating body.

4. The wiring strip according to claim 1, in which each of the conductive strips is selected from the group consisting of copper, aluminum, copper clad aluminum and copper alloy.

5. The wiring strip according to claim 1, in which the separate cavity is generally rectangular-shaped, having a base for carrying the conductive strip and a pair of opposing walls generally orthogonal to the base, a portion of each of the pair of opposing walls adjacent the base is angled inwardly to intersect the base and form a junction for capturing a mating connector.

6. The wiring strip according to claim 1, in which the insulating body is selected from a group consisting of thermoplastic and thermosetting resins.

7. The wiring strip according to claim 6, in which the resins are selected from a group consisting of polycarbonates (PC), acrylonitrile-butadiene-styrene resins (ABS) and polyethylene oxide resins (PPO).

8. The wiring strip according to claim 1, having a generally symmetrical trapezoid cross section in which the wiring strip includes a base, a top side parallel to and narrower than the base, and a pair of opposing walls joining the base to the top side and intersecting the base at an acute angle.

9. The wiring strip according to claim 8, having a notch in at least one of the opposing walls aligned with a mounting hole in the base for holding a fastener.

10. An electrical wiring connector comprising:

an insulating body having a first end surface;

a first cavity extending from the first end surface into the body and terminating at a first recessed end surface of the body;

a plurality of first insulating projections recessed in the first cavity and cantilevered from the first recessed end surface:

a plurality of conductive strips carried by the first insulating projections, each conductive strip having an exposed surface extending from the first recessed end surface to a distal end of each first insulating projection;

a second end surface opposite the first end surface;

a second cavity extending from the second end surface into the body and terminating at a second recessed end surface of the body; and a plurality of second insulating projections recessed in the second cavity and cantilevered from the second recessed end surface so that the plurality of conductive strips extend from the body and are carried by the second insulating projections, each conductive strip having an exposed surface extending from the second recessed end surface to a distal end of each second insulating projection.

11. The connector according to claim 10, in which each conductive strip fills the width of each first insulating projection.

12. The connector according to claim 10, having a metal cover surrounding the insulating body.

13. The connector according to claim 10, in which each of the conductive strips is selected from the group consisting of copper, aluminum, copper clad aluminum and copper alloy.

14. The connector according to claim 10, in which the insulating body is selected from a group consisting of thermoplastic and thermosetting resins.

15. The connector according to claim 14, in which the resins are selected from a group consisting of polycarbonates (PC), acrylonitrile-butadiene-styrene resins (ABS) and polyethylene oxide resins (PPO).

16. An electrical wiring system comprising:

a first elongated insulating body having first and second end surfaces;

a plurality of first conductive strips extending between the first and second end surfaces;

a plurality of first cavities extending from each of the first and second end surfaces into the first body, the first cavities adjoining the plurality of first conductive strips so that a surface portion of each first conductive strip is exposed within a corresponding first cavity; and a second insulating body having a first end surface;

a second cavity extending from the first end surface of the second insulating body into the second insulating body and terminating at a first recessed end surface of the second insulating body;

a plurality of first insulating projections recessed in the second cavity and cantilevered from the first recessed end surface of the second insulating body;

a plurality of second conductive strips carried by the first insulating projections, each second conductive strip having an exposed surface extending from the first recessed end surface of the second insulating body to a distal end of each first of insulating projection for electrically engaging said first conductive strips of said first elongated insulating body;

a second end surface of the second insulating body opposite the first end surface of the second insulating body:

a third cavity extending from the second end surface of the second insulating body into the second body and terminating at a second recessed end surface of the second body: and a plurality of second insulating projections recessed in the third cavity and cantilevered from the second recessed end surface so that the plurality of second conductive strips extend from the second body and are carried by the second insulating projections, each second conductive strip having an exposed surface extending from the second recessed end surface to a distal end of each second insulating projection.

17. The system according to claim 16, in which the area of the first end surface of the second insulating body is sufficiently greater than the area of the first end surface of the first insulating body so that the second cavity sealingly encompasses the first insulating body.

18. An electrical wiring system comprising;

a first elongated insulating body having a substantially uniform cross section throughout its length and first and second substantially planar end surfaces at opposite ends of the strip;

a plurality of first, generally flat, electrically conductive strips embedded in the first body, extending through the body and terminating in the same planes of the first and second end surfaces; and a plurality of separate first cavities formed in the first body adjacent to the first conductive strips, extending from each of the first and second end surfaces into the first body, so that a surface portion of each first conductive strip is exposed within the adjacent first cavity;

a second insulating body having a first end surface;

a second cavity extending from the first end surface of the second insulating body into the second insulating body and terminating at a first recessed end surface of the second insulating body;

a plurality of first insulating projections recessed in the second cavity and cantilevered from the first recessed end surface of the second insulating body;

a plurality of second conductive strips carried by the first insulating projections each second conductive strip having an exposed surface extending from the first recessed end surface of the second insulating body to a distal end of each first insulating projection for electrically engaging said first conductive strips of said first elongated insulating body;

a second end surface of the second insulating body opposite the first end surface of the second insulating body;

a third cavity extending from the second end surface of the second insulating body into the second body and terminating at a second recessed end surface of the second body; and a plurality of second insulating projections recessed in the third cavity and cantilevered from the second recessed end surface so that the plurality of second conductive strips extend from the second body and are carried by the second insulating projections, each second conductive strip having an exposed surface extending from the second recessed end surface to a distal end of each second insulating projection.

* * * * *